US007960974B1

(12) United States Patent
Moninger

(10) Patent No.: US 7,960,974 B1
(45) Date of Patent: Jun. 14, 2011

(54) IGNITION CURRENT TESTER

(76) Inventor: John A. Moninger, Washington, PA (US)

( * ) Notice: Subject to any disclaimer, the term of this patent is extended or adjusted under 35 U.S.C. 154(b) by 0 days.

(21) Appl. No.: 12/767,465

(22) Filed: Apr. 26, 2010

Related U.S. Application Data

(60) Provisional application No. 61/214,392, filed on Apr. 24, 2009.

(51) Int. Cl.
*F02P 17/00* (2006.01)

(52) U.S. Cl. ..... 324/395; 324/505

(58) Field of Classification Search ..... 324/380, 324/393, 395, 402
See application file for complete search history.

(56) References Cited

U.S. PATENT DOCUMENTS

| | | | | |
|---|---|---|---|---|
| 2,959,711 | A | | 11/1960 | Parmater et al. |
| 3,452,270 | A | | 6/1969 | Cook |
| 3,693,148 | A | | 9/1972 | Pittman |
| 3,806,796 | A | * | 4/1974 | Goldstein ..... 324/384 |
| D244,364 | S | | 5/1977 | Rasmussen |
| 4,063,152 | A | | 12/1977 | Reeves |
| 4,292,591 | A | | 9/1981 | Doss |
| 4,305,038 | A | | 12/1981 | Luzynski |
| 4,547,734 | A | | 10/1985 | Spaude |
| 4,942,362 | A | | 7/1990 | Lance |
| 5,652,381 | A | * | 7/1997 | Fuchs ..... 73/114.62 |
| 5,675,257 | A | | 10/1997 | Frus |
| 6,836,120 | B1 | * | 12/2004 | Lite ..... 324/388 |

* cited by examiner

*Primary Examiner* — Vincent Q Nguyen
(74) *Attorney, Agent, or Firm* — Montgomery Patent and Design; Robert C. Montgomery

(57) ABSTRACT

An apparatus to aid in the testing of engine ignition systems is herein disclosed. The apparatus is connected in a series wiring path between a spark plug wire and a spark plug of an internal combustion-type engine. The apparatus comprises a housing containing a resistor and a lamp which provide illuminated indication of a current flowing through the apparatus. The apparatus allows a user to quickly determine if an ignition circuit of an engine is operating properly.

18 Claims, 3 Drawing Sheets

IGNITION CURRENT TESTER

RELATED APPLICATIONS

The present invention was first described in and claims the benefit of U.S. Provisional Patent No. 61/214,392 filed Apr. 24, 2009, the entire disclosures of which are incorporated herein by reference.

FIELD OF THE INVENTION

The present invention relates generally to automobile ignition systems, and in particular, to a device adapted for quickly and accurately assessing the state of a spark plug ignition portion of an automobile ignition system.

BACKGROUND OF THE INVENTION

One (1) particular type of work found around motor vehicles, small engine repair shops, farms, and the like is that of engine repair. One (1) critical factor that must be verified at an early stage of repair diagnosis is that of a proper spark being supplied by the ignition system. Since the spark is provided in the interior of the combustion cylinder, a mechanic must rely on other indications of a proper spark which may not be highly reliable.

The verification of proper spark firing is a time consuming and difficult process which is nonetheless critical in the assessment of engine repair. Conventional methods for testing the working status of the system involve the removal and replacement of various portions of the system in order to access the components necessary to test the electrical current and the like. Such methods are expensive due to the time and labor involved in the removal and replacement processes.

Various attempts have been made to provide a device for verifying the status of an ignition system. Examples of these attempts can be seen by reference to several U.S. patents. For example, U.S. Pat. No. 3,693,148, issued in the name of Pittman, describes an integral engine timing light. U.S. Pat. No. 4,292,591, issued in the name of Doss, describes an ignition performance monitor for permanent installation in a motor vehicle. U.S. Pat. No. 4,942,362, issued in the name of Lance, describes an apparatus adapted to test the status of these types of ignition systems.

While these devices fulfill their respective, particular objectives, each of these references suffer from one (1) or more of the aforementioned disadvantages. Many such devices involve permanent installments which are not standard on existing vehicles and which are inefficient or cost prohibitive for one (1) time use when attempting to verify the state of an existing ignition system prior to engine work. Also, many such devices require significant work prior to testing including the removal and subsequent replacement of various parts of the system between each test. Accordingly, there exists a need for an ignition current tester without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to quickly test the working status of an existing conventional spark plug engine ignition system without undue labor associated with conventional methods of accessing internal portions of the system. Thus, the object of the present invention is to solve the aforementioned disadvantages and provide for this need.

To achieve the above objectives, it is an object of the present invention to provide a means for testing and verifying proper operation of an engine ignition system. The apparatus provides an illuminated visual indication of a current being conducted to a spark plug. The apparatus comprises first and second electrical cables, a post connector, a housing, a lamp, and a spark plug connector.

Another object of the present invention is to connect to an existing ignition source, such as a spark plug wire, and a spark plug such that as an internal current flows through the apparatus, the lamp is illuminated indicating that sufficient current is present to cause a spark plug to function properly.

Yet still another object of the present invention is to provide an inserting attachment means into a boot connector portion of an existing spark plug wire. This is accomplished via the post connector, which comprises a highly-conductive copper tip which physically mimics a terminal end of a common spark plug.

Yet still another object of the present invention is to provide an attachment means to an existing spark plug via the spark plug connector. The spark plug connector comprises a molded cup-like form which provides an interference fit to the spark plug.

Yet still another object of the present invention is to allow convenient viewing of the lamp by a user. The lamp is contained within the housing, which comprises a flush-mounted transparent viewing lens along a top surface.

Yet still another object of the present invention is to indicate to a user that sufficient current is present to cause a spark plug to function properly. The circuit further comprises a resistor interconnected in a parallel wiring path with the lamp which produces a voltage drop adequate to power the lamp when sufficient current is present.

Yet still another object of the present invention is to allow an engine to run with the apparatus in place such that a user can observe whether the ignition system is functioning properly under operational conditions, allowing the user to identify problems such as intermittent ignitions and the like.

Yet still another object of the present invention is to provide safe operation via the housing and via insulation portions which are located around the electrical cables, providing an effective waterproof barrier to the electrical portions of the apparatus.

Yet still another object of the present invention is to allow multiple units of the apparatus to be utilized simultaneously in order to test multiple cylinders of an existing engine at the same time.

Yet still another object of the present invention is to provide a method of utilizing the device that provides a unique means of quickly connecting the post connector and spark plug connector to an existing boot connector portion and spark plug wire of an existing engine respectively, starting the engine, and observing illumination of the lamp through the viewing lens in order to accurately assess and troubleshoot the operating status of the ignition system of the existing motor vehicle.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY1

Figure 1:
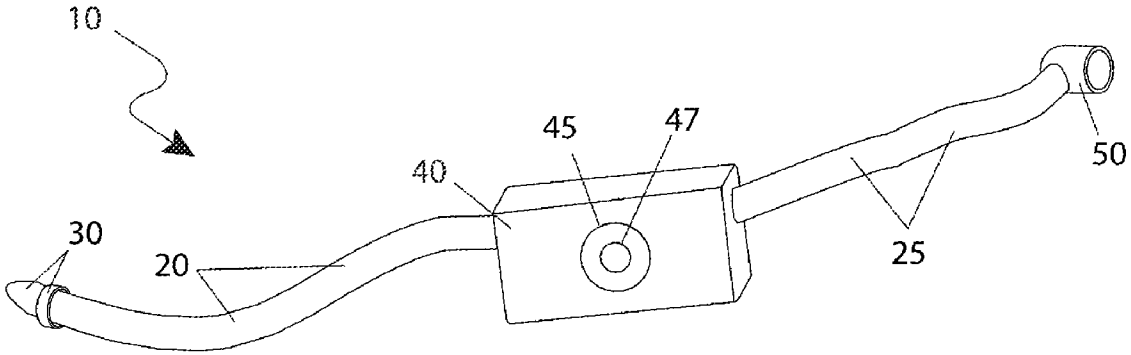
FIG. 1 is a perspective view of an ignition current tester 10, according to a preferred embodiment of the present invention.

10 ignition current tester
20 first electrical cable
25 second electrical cable
27 wiring
30 post connector
40 housing
41 grommet
42 wire clamp
43 resistor
45 viewing lens
47 lamp
50 spark plug connector
60 boot connector
70 spark plug wire
80 spark plug
85 illumination
90 fastener
95 adhesive

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an ignition current tester (herein described as the "apparatus") 10, which provides a means for testing and verifying proper operation of an engine ignition system comprising an illuminated visual indication of a current being conducted to a spark plug 80. The apparatus 10 is connected in an in-line manner between an ignition source such as a spark plug wire 70, and a spark plug 80. As an internal current flows through the apparatus 10, an internal lamp 47 is illuminated 85, thereby indicating that sufficient current is present to cause a spark plug 80 to function properly in an engine. A user may utilize the apparatus 10 on various motorized equipment utilizing spark plugs 80 such as, but not limited to: motor vehicles, small engines, tractors, or the like.

Referring now to FIG. 1, a perspective view of the apparatus 10, according to the preferred embodiment of the present invention, is disclosed. The apparatus 10 comprises a first electrical cable 20, a second electrical cable 25, a post connector 30, a housing 40, a lamp 47, and a spark plug connector 50. The post connector 30 provides an inserting attachment means into a boot connector portion 60 of an existing spark plug wire 70 (see FIG. 2). The post connector 30 comprises a highly-conductive crimped and/or soldered copper tip which physically mimics a terminal end of a common spark plug 80. The post connector 30 is connected to, and in electrical communication with the housing 40 via a first electrical cable 20 comprising a length of standard insulated high voltage ignition cable.

Figure 3:
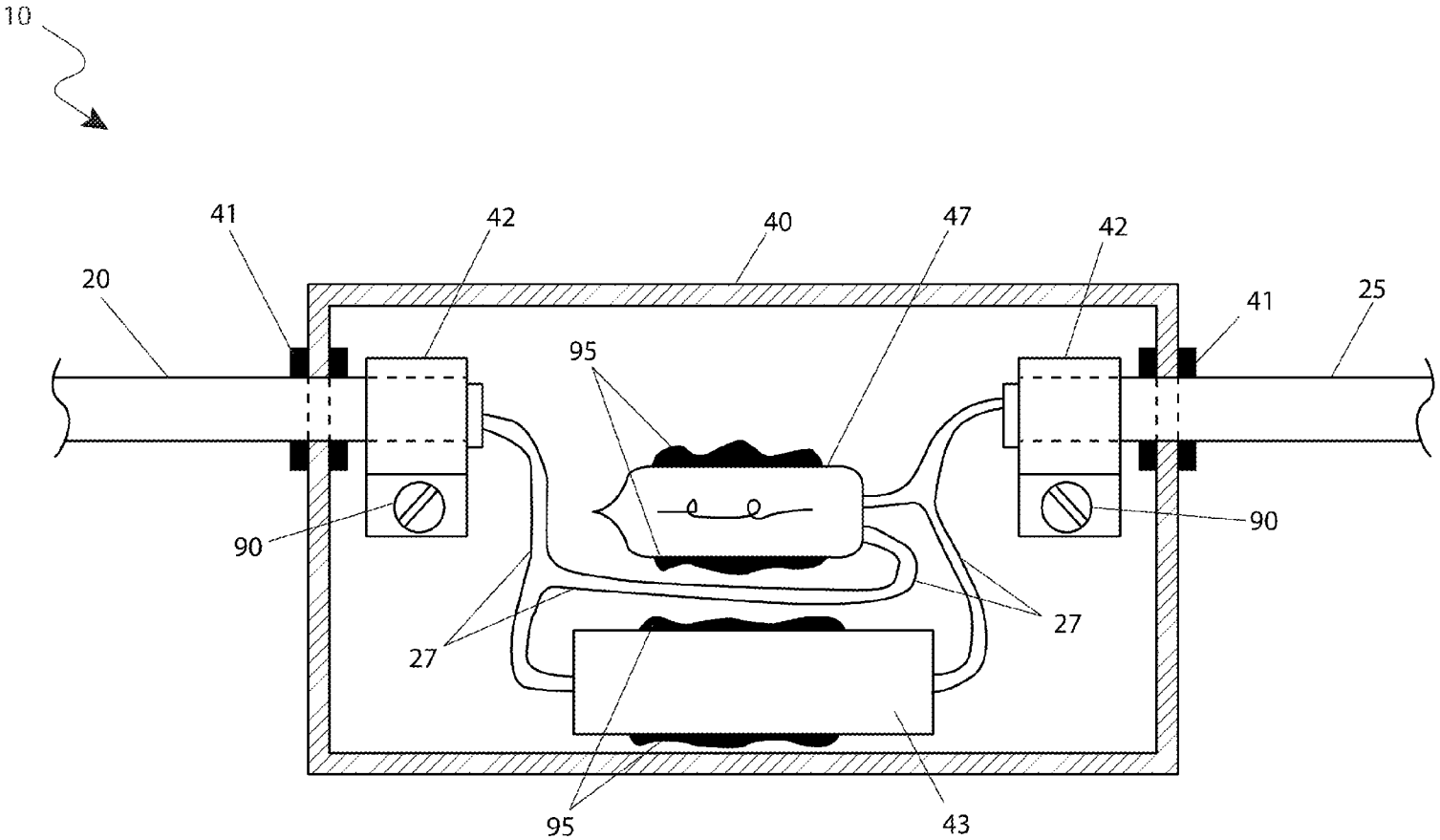
FIG. 3 is a section view of the ignition current tester 10 taken along section line A-A (see FIG. 2), according to a preferred embodiment of the present invention; and, FIG. 4 is an electrical block diagram of the ignition current tester 10, according to a preferred embodiment of the present invention.

The housing 40 comprises a durable plastic enclosure providing sealed protection thereto an internal lamp 47 (see FIG. 3). The housing 40 also comprises a flush-mounted transparent or translucent viewing lens 45 along a top surface to allow convenient viewing of said lamp 47 by a user. In a similar manner as the aforementioned first electrical cable 20, a proximal end portion of the second electrical cable 25 is affixed to an opposite side surface of the housing 40. The distal end portion of said second electrical cable 25 provides an attachment means thereto the spark plug connector 50. The spark plug connector 50 comprises a molded cup-like form similar in construction and function to the boot connector portion 60 of the spark plug wire 70, thereby providing an inserting connection means thereto an existing spark plug 80 by applying an engaging interference fit.

Figure 2:
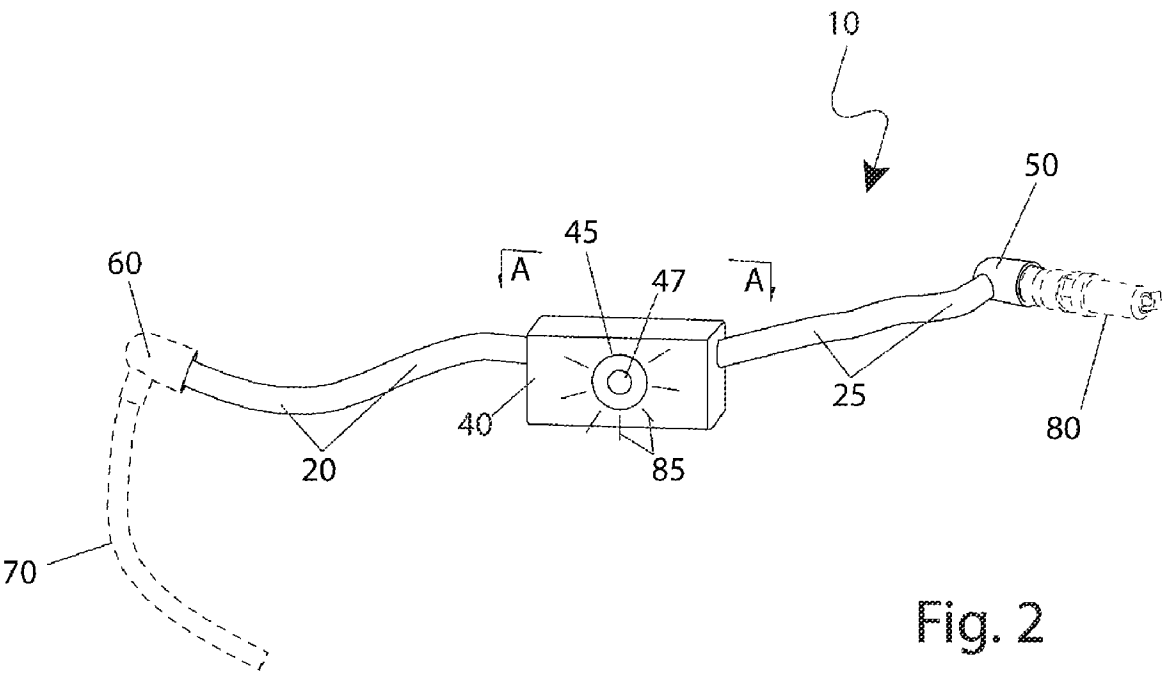
FIG. 2 is an environmental view of the ignition current tester 10 depicting an in-use state, according to a preferred embodiment of the present invention.

Referring now to FIG. 2, an environmental view of the apparatus 10 depicting an in-use state, according to the preferred embodiment of the present invention, is disclosed. An electrical current from an ignition source such as a coil or distributor passes through the apparatus 10 to the spark plug 80. The post connector 30 physically mimics a terminal end of a common spark plug 80, thereby allowing engagement of an existing boot connector portion 60 of an existing spark plug wire 70 providing a slight interference fit into. To utilize the apparatus 10 a user would insert the post connector 30 into the existing boot connector portion 60 of the spark plug wire 70, and insert the existing spark plug 80 into the spark plug connector 50 to establish a current flow. As power flows from the ignition system through the apparatus 10 to the spark plug 80, the lamp 47 provides an illumination 85 to indicate a successful test. The engine being tested can be run with the apparatus 10 in place to observe, for example, an intermittent ignition or similar ignition problem. It is understood that multiple units of the apparatus 10 may also be utilized to test several cylinders of the engine at once.

The electrical cables 20, 25 each comprise a length of insulated ignition wire approximately six (6) inches in length and approximately a quarter (¼) inch in diameter being capable of withstanding expected voltages normally provided to a spark plug 80. Additionally, the insulation portion of the electrical cables 20, 25 is to provide an effective waterproof barrier.

Referring now to FIG. 3, a section view of the apparatus 10 taken along section line A-A (see FIG. 2), according to a preferred embodiment of the present invention, is disclosed. The housing 40 comprises a durable rectangular plastic enclosure providing sealed protection thereto an internal resistor 43 and a lamp 47. The electrical cables 20, 25 enter the housing 40 through opposing side surfaces of said housing 40 being secured thereto said housing 40 using respective wire clamps 42 mounted within the housing 40. The wire clamps 42 fit tightly around an insulated end portion of each cable 20, 25 and are affixed thereto a bottom surface of the housing 40 using common fasteners 90. Additionally, a connection between the housing 40 and said electrical cables 20, 25 is accomplished using common rubber grommets 41. An ignition current flowing through said electrical cables 20, is routed to the resistor 43 and the lamp 47 via internal wiring 27 extending from the clamped end portion of the cables 20, 25 into the housing 40. The resistor 43 and lamp 47 are to be secured to an interior bottom surface of the housing 40 using an adhesive 95 such as, but not limited to: RTV silicone, glue, or the like.

Figure 4:
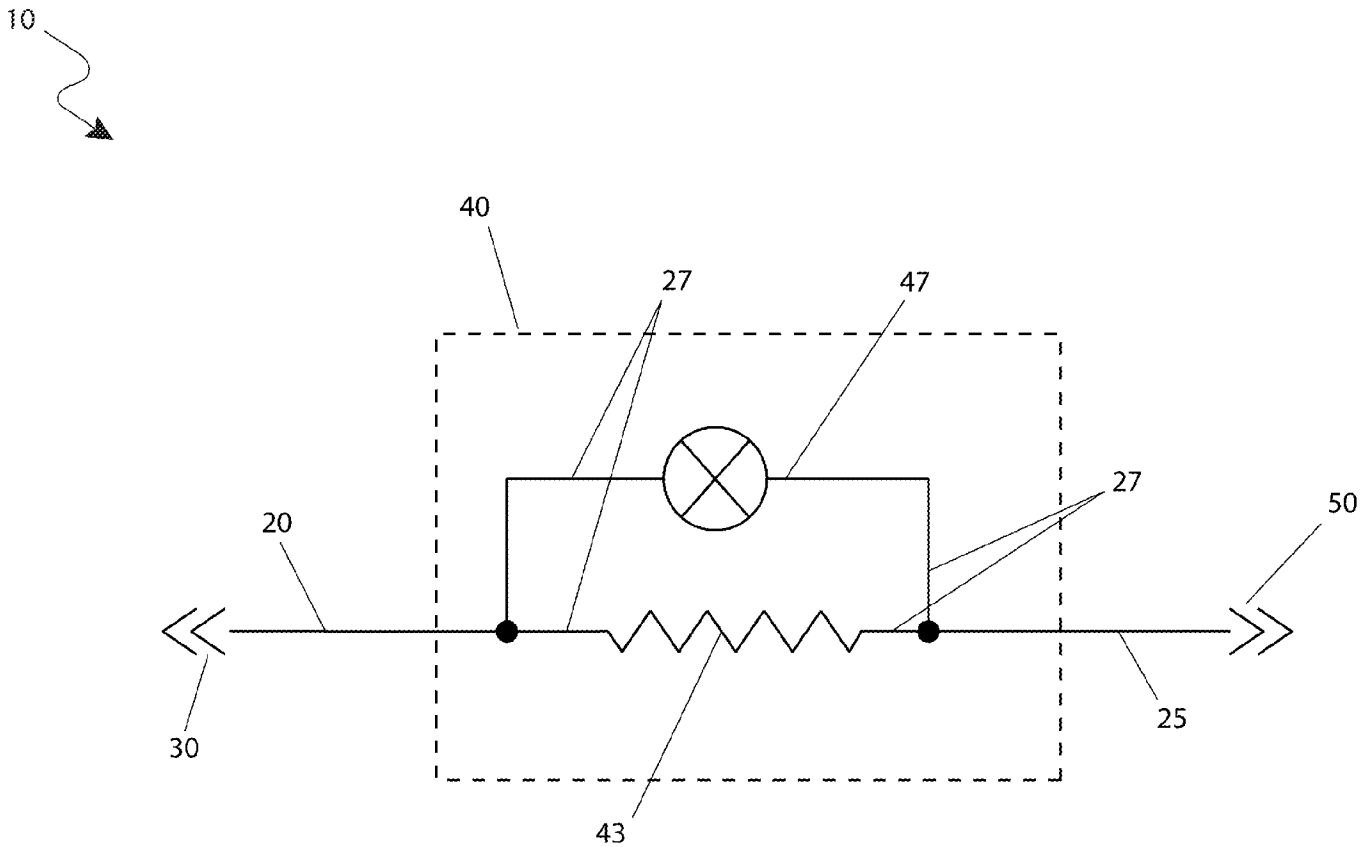

Referring now to FIG. 4, an electrical block diagram of the apparatus 10, according to the preferred embodiment of the present invention, is disclosed. The resistor 43 and lamp 47 are interconnected in a parallel wiring path via internal electrical wiring 27. The resistor 43 produces a voltage drop being adequate to power the lamp 47. The resistor 43, lamp 47, electrical wiring 27, and any other necessary electrical components are enclosed within the housing 40. The resistor 43 is envisioned to provide a value of approximately four thousand seven hundred ohms (4700Ω); however, alternate resistor values may be selected to produce a desired amount of illumination 85 of the lamp 47. The lamp 47 preferably comprises a T-2 neon lamp; however, other illuminating devices may be provided with equal benefit such as, but not limited to: a light-emitting diode (LED), a wire ended lamp, a Candelabra Edison Screw lamp, and other such electric powered lighting components.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 2.

The method of utilizing the apparatus 10 may be achieved by performing the following steps: acquiring at least one (1) unit of the apparatus 10; disconnecting an existing boot connector 60 from an existing spark plug 80; inserting the post connector 30 into said boot connector 60; inserting the spark plug connector 50 onto the existing spark plug 80; starting the engine; observing illumination 85 provided by the lamp 47 through the viewing lens 45 due to the passing of current through the apparatus 10, thereby troubleshooting an ignition system; replacing and/or cleaning faulty spark plugs 80 or performing other needed repairs; repeating the ignition current test using the apparatus 10 on remaining spark plugs 80 as needed; and, benefiting from accurate and safe testing of ignition wiring and spark plugs 80 afforded a user of the present apparatus 10.

The engine being tested can be run with the apparatus 10 in place to observe an intermittent ignition problem. It is understood that multiple units of the apparatus 10 may also be utilized to test several cylinders of the engine at once.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A current tester, comprising:

a housing;

a first electrical cable outwardly extending from a side wall said housing, terminating with a first connector;

a second electrical cable outwardly extending from an opposing side wall of said housing from said first electrical cable, terminating with a second connector; and, an illumination means in electrical communication with said first connector and said second connector for detecting and providing a visual indication of passage of current through said tester, said illumination means housed within said housing;

wherein said current tester is in electrical communication with a power source with said first connector and a spark plug with said second connector, wherein said housing further comprises a durable plastic enclosure providing a sealed protection means thereto said illumination means, wherein said sealed protection means further comprises a flush-mounted transparent or translucent viewing lens along a to surface thereof.

2. The current tester of claim 1, wherein said first electrical cable and said second electrical cable each further comprise a length of standard insulated high voltage ignition cable with waterproof insulation.

3. The current tester of claim 2, wherein each of said first electrical cable and said second electrical cable are affixed to said housing with a grommet and a wire clamp.

4. The current tester of claim 1, wherein said first connector is a post connector for electrical communication with a boot connector of said power source.

5. The current tester of claim 3, wherein said post connector further comprises a highly-conductive crimped or soldered copper tip.

6. The current tester of claim 1, wherein said second connector is a boot connector for electrical communication with said spark plug.

7. The current tester of claim 1, wherein said illumination means further comprises:

a resistor secured to an interior surface of said housing and in electrical communication with said first electrical cable and said second electrical cable; and, a lamp secured to an interior surface of said housing adjacent to said resistor and in electrical communication with said resistor;

wherein a current supplied by said power source is routed through said first electrical cable into said resistor; and;

wherein said resistor produces a voltage drop to power said lamp.

8. The current tester of claim 7, wherein said resistor is rated at approximately 4700 ohms.

9. The current tester of claim 7, wherein said lamp further comprises a T-2 neon lamp.

10. A current tester to detect and indicate a present of current, comprising:

a housing, comprising a enclosure with a first aperture and a first grommet and a second aperture with a second grommet located on opposing outer walls;

a first electrical cable outwardly extending from said housing through said first aperture, terminating with a first connector, and attached to an interior of said housing via a wire clamp;

a second electrical cable outwardly extending from said housing through said second aperture, terminating with a second connector, and attached to an interior of said housing via a wire clamp; and, an illumination means in electrical communication with said first connector and said second connector for detecting and providing a visual indication of passage of current through said tester, said illumination means housed within said housing, further comprising:

a resistor secured to an interior surface of said housing and in electrical communication with said first electrical cable and said second electrical cable; and, a lamp secured to an interior surface of said housing adjacent to said resistor and in electrical communication with said resistor;

wherein said current tester is in electrical communication with a power source with said first connector and a spark plug with said second connector;

wherein a current supplied by said power source is routed through said first electrical cable into said resistor; and;

wherein said resistor produces a voltage drop to power said lamp to provide a visual indication of said current.

11. The current tester of claim 10, wherein said housing further comprises a durable plastic enclosure providing a sealed protection means thereto said illumination means.

12. The current tester of claim 11, wherein said sealed protection means further comprises a flush-mounted transparent or translucent viewing lens along a top surface thereof.

13. The current tester of claim 10, wherein said first electrical cable and said second electrical cable each further comprise a length of standard insulated high voltage ignition cable with waterproof insulation.

14. The current tester of claim 10, wherein said first connector is a post connector comprises a highly-conductive crimped or soldered copper tip for electrical communication with a boot connector of said power source.

15. The current tester of claim 10, wherein said second connector is a boot connector for electrical communication with said spark plug.

16. The current tester of claim 10, wherein said resistor is rated at approximately 4700 ohms.

17. The current tester of claim 10, wherein said lamp further comprises a T-2 neon lamp.

18. A method for testing and verifying proper operation of an engine ignition system with an ignition current tester, comprising the following steps:

providing said ignition current tester, further comprising:

a housing, comprising a enclosure with a first aperture and a first grommet and a second aperture with a second grommet located on opposing outer walls, and a flush-mounted transparent or translucent viewing lens along a top surface;

a first electrical cable outwardly extending from said housing through said first aperture, terminating with a first connector, and attached to an interior of said housing via a wire clamp;

a second electrical cable outwardly extending from said housing through said second aperture, terminating with a second connector, and attached to an interior of said housing via a wire clamp; and, an illumination means in electrical communication with said first connector and said second connector for detecting and providing a visual indication of passage of current through said tester, said illumination means housed within said housing, further comprising:

a resistor secured to an interior surface of said housing and in electrical communication with said first electrical cable and said second electrical cable; and, a lamp secured to an interior surface of said housing adjacent to said resistor and in electrical communication with said resistor;

connecting said first connector to said power source;

connecting said second connector to a spark plug;

starting an engine of said engine ignition system; and, observing illumination provided by said lamp through said viewing lens due to passage of current through said ignition current tester.

* * * * *